United States Patent [19]

Steiner et al.

[11] Patent Number: 4,931,142

[45] Date of Patent: Jun. 5, 1990

[54] LONG-NIP ROLL PRESS WITH ECCENTRIC TRAVEL PATH OF PRESS SHELL

[75] Inventors: Karl Steiner, Herbrechtingen; Josef Müllner, Heidenheim; Christian Schiel, Heidenheim; Hans Flämig, Heidenheim, all of Fed. Rep. of Germany

[73] Assignee: J. M. Voith GmbH, Fed. Rep. of Germany

[21] Appl. No.: 164,542

[22] Filed: Mar. 7, 1988

[30] Foreign Application Priority Data

Mar. 13, 1987 [DE] Fed. Rep. of Germany ..... 3708189

[51] Int. Cl.[5] ..... D21F 3/08

[52] U.S. Cl. ..... 162/358; 29/116.2; 100/153; 162/205; 162/361

[58] Field of Search ..... 162/358, 361, 205; 100/121, 153, 118, 154; 29/118, 119, 130, 131, 116 AD

[56] References Cited

U.S. PATENT DOCUMENTS

| | | | |
|---|---|---|---|
| 4,503,765 | 3/1985 | Schiel | 162/358 |
| 4,584,059 | 4/1986 | Schiel et al. | 162/358 |
| 4,625,376 | 12/1986 | Schiel et al. | 29/119 |
| 4,643,802 | 2/1987 | Schiel | 162/358 |
| 4,673,461 | 6/1987 | Roerig et al. | 162/205 |

FOREIGN PATENT DOCUMENTS

| | | | |
|---|---|---|---|
| 107607 | 5/1984 | European Pat. Off. | 162/358 |
| 3030233 | 2/1982 | Fed. Rep. of Germany . | |
| 79919 | 2/1971 | German Democratic Rep. . | |

*Primary Examiner*—Karen M. Hastings

*Attorney, Agent, or Firm*—Ostrolenk, Faber, Gerb & Soffen

[57] ABSTRACT

A long-nip press roll and a mating roll form an areal press nip with each other. The long-nip press roll has a flexible tubular press shell which is mounted by means of two support disks on a stationary support member which extends through the inside of the press shell. Within a hydraulic pressure chamber provided on the supporting member is a radially displaceable press shoe which can press the press shell against the mating roll. Support member, pressure chamber and mating roll are arranged symmetrically relative to a press plane. The slide surface of the press shoe which contacts the press shell is arranged offset with respect to the press plane in the direction opposite the direction of travel of the press shell. The axis of rotation of the press shell and its two support disks is also arranged offset out of the press plane in the direction opposite the direction of travel of the press shell.

11 Claims, 1 Drawing Sheet

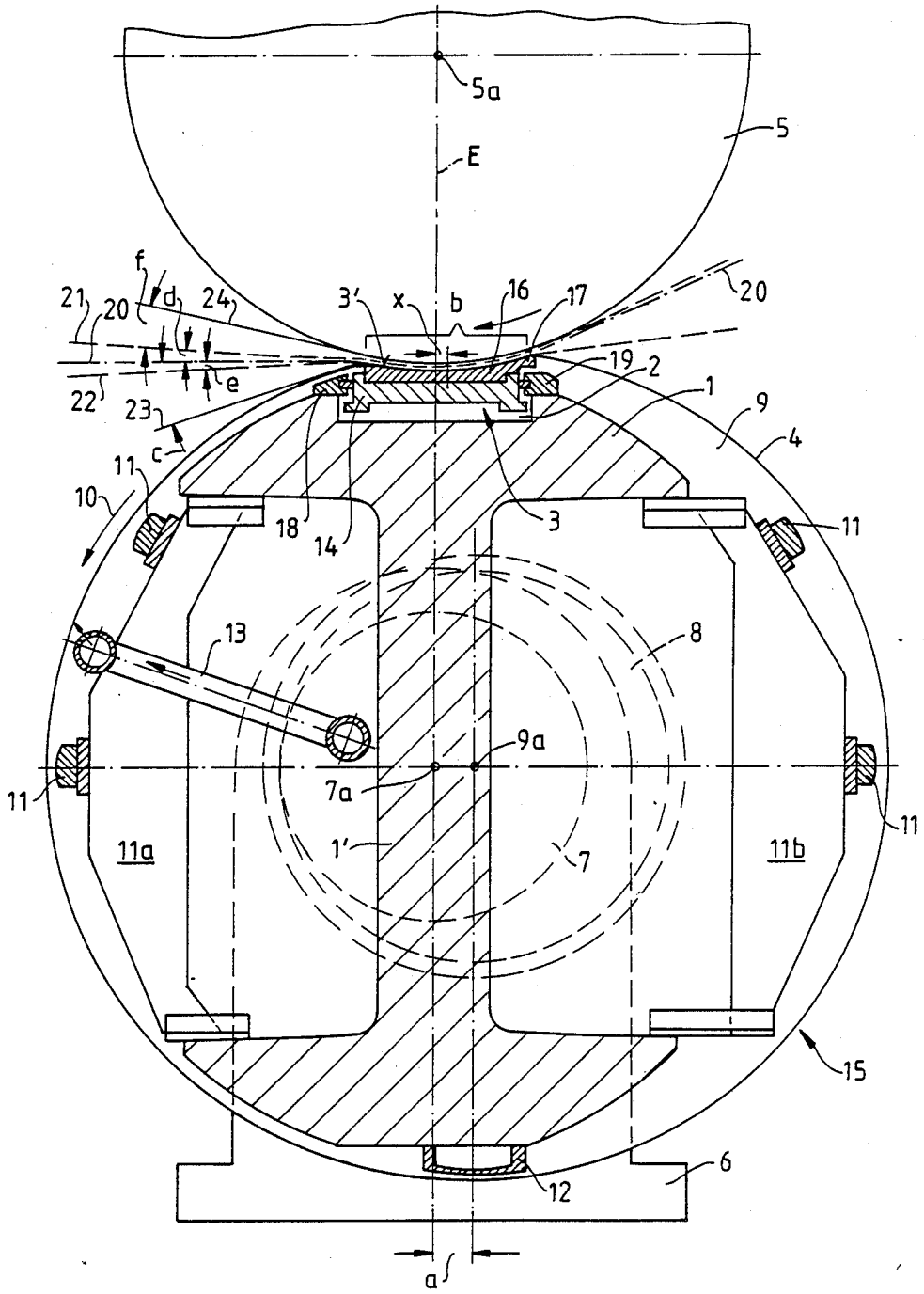
5a
5
E
f
d
24
21
20
3'
x
b
16
17
20
19
2
1
9
4
e
22
23
c
11
10
18
14
3
11
13
8
9a
7a
11
11
11a
1'
7
11b
15
6
12
a

LONG-NIP ROLL PRESS WITH ECCENTRIC TRAVEL PATH OF PRESS SHELL

BACKGROUND OF THE INVENTION

1. Field Of The Invention

The present invention relates to a long-nip roll press comprising a press shell that passes continuously over a press shoe supported in a recess on a supporting member, and a mating roll that opposes the press shoe.

2. Description Of Related Art

The following publications are in the background of the present invention:

1. U.S. Pat. No. 4,625,376 issued Dec. 2, 1986, commonly assigned herewith, whose disclosures are incorporated by reference herein.

2. U.S. Pat. No. 4,643,802 issued Feb. 17, 1987, commonly assigned herewith, whose disclosures are incorporated by reference herein.

3. German Democratic Republic Patent 79,919 issued Feb. 12, 1971.

4. Federal Republic of Germany Patent 3,030,233.

Long-nip presses are successfully used in press ends of paper machines. Their advantage over ordinary roll presses is that, due to the extended length of the press nip in the direction of travel, better water removal performance can be obtained. By the use of a tubular press shell fastened on supporting disks, as disclosed in U.S. Pat. No. 4,625,376, the inside of the press shell is hermetically closed off from the outside so that there is no danger of contamination by penetration of a lubricant from the inside to the outside of the press shell. The press shell is connected in pressure-tight manner to supporting disks, which are mounted on a stationary support member. In this way it is possible to develop a certain excess pressure within the press shell by feeding in compressed air. This improves the quietness of travel of the press shell. Further quietness is obtained by connecting the two ends of the press shell precisely coaxially to each support disk by a centering device. This, together with the internal pressure produced by the compressed air, has the result that the press shell, upon rotation, slides only over the press shoe and is otherwise free of contact as it revolves around the support member. In other words, no guide elements, for instance ledges over which the press shell would slide upon rotation, are required within the press shell.

The forces occurring in the press nip of such a long-nip roll press are substantially greater than in a traditional two-roll press. The order of magnitude of the line force can be 1000 kN/m. The pressing forces which are applied to the machine frame by the support member and the mating roll are correspondingly high. It is therefore important that (as suggested by U.S. Pat. No. 4,643,802) a symmetrical arrangement of the support member, the press-shoe pressure chamber and the mating roll be provided. In this way, it is assured that the pressing forces are introduced into the machine frame at least predominantly in one and the same plane, namely in the press plane, the press plane being preferably (but not necessarily) substantially vertical. Oblique directions of force or directions of force which are staggered with respect to each other, which occur for instance in the apparatus disclosed in GDR Patent 79,919 and FRG Patent 3,030,233, are undesirable since they would result in disturbing transverse forces or bending moments.

The above-described guidance of the forces in the preferably vertical press plane may also be obtained when the center of the slide surface of the press shoe is displaced outside the press plane, as disclosed in U.S. Pat. No. 4,643,802. This displacement of the slide surface serves the purpose of obtaining an asymmetric pressing-pressure distribution in the direction of travel of the paper. More specifically, the pressing pressure is desired, commencing at the entrance into the press nip, to initially gradually increase up to a maximum, and then, shortly before the emergence from the press nip, to suddenly decline. In this way, remoistening of the web of paper by the felts, at the outlet from the press nip, is reduced.

SUMMARY OF THE INVENTION

Thus, good water-removal performance can be obtained with known long-nip roll presses. Nevertheless, further improvements appear desirable. Accordingly, a central object of the present invention is further to increase the dry content of the paper at the end of the press end of the paper machine, so that the consumption of energy for the subsequent thermal drying of the web of paper can be further decreased.

This object is achieved in a long-nip roll press comprising: a pedestal, a support member having a central axis and supported on the pedestal, and a mating roll having a central axis; these central axes defining a preferably (but not necessarily) vertical press plane. A flexible, preferably inflatable, tubular press shell is rotatably mounted on the support member for rotating in a path of travel, preferably circular, about a central axis of the press shell and about the support member. A hydraulic press shoe is mounted on the support member substantially symmetrically to the press plane, for pressing the press shell against the mating roll, and thereby forming an areal press nip between the press shell and the mating roll. A web to be dewatered and at least one felt dewatering belt, or preferably two belts, are driven and guided in a web travel direction through the areal press nip for dewatering the web.

The central axis of the press shell is offset from the press plane in a direction opposite the web travel direction; whereby the travel path of the press shell is eccentric to the press plane.

Advantageously, the means for guiding the press shell comprises a pair of support disks rotatably mounted on the support member; the press shell being symmetrically secured to said support disks.

A plurality of paraxial mounting-aid strips are desirably mounted on the support member concentrically with the central axis of the press shell, and thereby eccentrically to the press plane.

The press shoe has a slide surface which contacts the inside surface of the press roll and defines a width of the areal press nip in the direction of web travel. Advantageously, the center of the slide surface is spaced from the press plane in a direction opposite the direction of web travel. Preferably, the press shoe has an extension on a side thereof opposite said web travel direction, which offsets the center of the slide surface of the press shoe from the press plane such that the extension is located substantially within the path of travel of the press shell.

The paper web and the one or two felt belts are driven and guided so as to form with each other a selected fixed or variable angle, preferably substantially 3°, adjacent the press nip.

In previous roll presses, for instance in accordance with U.S. Pat. No. 4,643,802, the travel path of the press shell was arranged essentially concentric around the axis of the support member (aside from the region of the press nip). This followed directly from the fact that heretofore the two support disks, on which the press shell is coaxially fastened, are mounted on the support member concentrically to the axis of the support member. This arrangement allows the use of simple bearing elements, with centering and bearing surfaces which are coaxial to each other. However, the present inventors have observed that by this concentric travel of the press shell, the web of paper, after its emergence from the press nip, moves for a certain distance in contact with the press shell, and also in contact with the felt belt between the paper web and the press shell, before the paper web detaches itself from the felt belt. Although this joint path of travel is relatively short, it nevertheless gives rise to a danger of remoistening of the paper web by the felt belt, despite the above-explained asymmetric distribution of pressing pressure in the direction of travel of the paper.

The tendency towards remoistening which has been described above is further aggravated by the fact that the press shell, as explained above, is distended, for example by the press shoe, as a result of which the length of the joint path of travel is further increased.

This remoistening tendency is substantially avoided by the present invention.

In the construction in accordance with the invention, the support disks to which the press shell ends are fastened are arranged eccentrically, being supported on bearing elements with centering and bearing surfaces lying eccentric to each other. By this shifting of the circular path of rotation of the press shell, the advantage is obtained that the web of paper detaches itself much earlier than in prior systems from the felt belt which travels along between paper web and the press shell. In other words, the joint path of travel of the paper web, felt belt and press shell, following their emergence from the press nip, is substantially shorter than previously. It is even possible with the invention to make the length of this joint path of travel equal to zero. In other words, the web of paper detaches itself from the said felt belt directly at the emergence from the press nip. In this way, remoistening of the web of paper is completely, or at least substantially completely, avoided. As another result, there can be expected a dry content of the paper web which is, for instance, 2% higher. For example, there may be an increase in the dry content to 48% as compared to a previous value of 46%. A further advantageous result is that, despite the eccentric arrangement of the path of revolution of the press shell, the pressing forces to be transmitted to the machine frame are, as previously, substantially in the press plane.

It has previously been attempted to improve the dry content of the paper web as it exits from the press nip. For example, GDR Patent 79,919 suggests it is desirable to separate the paper web and felt belt in a long-nip press directly at the outlet from the press nip in order to avoid remoistening of the web of paper. In that case, however, instead of a tubular press shell fastened, for instance, on support disks, an elastic endless belt is provided which travels over guide rolls, so that its path of travel is not preestablished by the circular periphery of support disks. The guiding of the belt by guide rolls has the disadvantage that the inner space enclosed by the belt cannot be closed on the two lateral ends, so that lubricants can penetrate to the outside and can contaminate the roll press and, possibly, also the web of paper passing through it. Another disadvantage of this prior roll press is that the axis of rotation of the mating roll is arranged alongside the central plane of the press-shoe pressure chamber, so that undesired transverse forces occur.

The manner of construction of the present invention combines the following advantages:

1. Outside the pressing zone, the path of revolution of the press shell is a simple circular path, as seen in cross-section.

2. The inner space of the press shell is not only sealed off from the outside, but it can furthermore be acted on, by feeding in compressed air, by a certain excess pressure which (if necessary) can be relatively high.

3. Due to the centering of the press shell on the two supporting disks, which are mounted eccentrically relative to the support member, and to the excess pressure prevailing in the inside of the press shell, it is not necessary to guide the rotating press shell by slide ledges or the like.

4. The remoistening of the paper web upon emergence from the press nip is kept small, not only by the fact that the press pressure suddenly drops in the region of emergence from the press nip, but also by the fact that the web of paper detaches itself very rapidly from the felt belt which passes through the press nip between paper web and press shell.

5. Although the travel path of the press shell deviates from a circular shape in the pressing zone, the press shell is only relatively slightly mechanically stressed by the press shoe. This will be explained further below with reference to the drawing.

The roll press of the invention may also comprise a second felt belt which may pass through the nip between the paper web and the mating roll. As a further means for attaining the objects in view, the means for guiding the two felt belts may be adjusted to avoid remoistening as much as possible. Details with respect to this will be explained in the course of the following description of an embodiment of the invention.

BRIEF DESCRIPTION OF THE DRAWING

The drawing is a cross-sectional view of a long-nip roll press which embodies the invention.

DESCRIPTION OF AN EMBODIMENT OF THE INVENTION

The vertical press plane of the roll press shown is designated E. The roll press comprises a long-nip press roll, designated generally as 15, and a mating roll 5. A support member 1 of I-shaped cross-section is arranged substantially symmetrically to the press plane E. In other words, at least the vertical arm 1' of the support member 1 is arranged centrally to the press plane E. The same is true of a recess 2 which forms a hydraulic pressure chamber for a press shoe 3 therein.

Around the support member 1 and around the press shoe 3 there travels a flexible tubular inflatable press shell 4. By the feeding of pressure fluid into the hydraulic pressure chamber 2, the press shoe 3 can be pushed against the inner side of the press shell 4 and the press shell in this way pressed against the mating roll 5. The axis of rotation 5*a* of the latter lies, in a symmetrical arrangement, also in the press plane E. The press shoe 3 has a concave slide surface 3' which is adapted to the mating roll 5 and the width of which (in the cross-section shown) is designated b.

The drawing furthermore shows a bearing pedestal 6 for supporting the support member 1, via a centrally arranged bearing pin 7 having a central axis *7a*. The pedestal 6 is also arranged symmetrical to the press plane E. A support disk 9 of the press shell 4 is supported on the bearing pin 7 via an eccentric bearing element 8 as explaind below. One such support disk 9, bearing pin 7 and bearing pedestal 6 is arranged on each end of the support member 1. A similar arrangement, but without an eccentric bearing element, is shown in longitudinal section in FIG. 1 of U.S. Pat. No. 4,625,376. It can be noted therefrom that the outside diameter of the support disks is only slightly smaller than the inside diameter of the press shell. It is furthermore seen that the press-shell ends are centered on the support disks.

Because the axes *5a* and *7a* lie in the press plane E, and thus support member 1, pressure chamber 2 and mating roll 5 are arranged symmetrically with respect to the press plane, transverse forces are avoided when the pressing force is transmitted by the press shoe 3. Due to the vertical arrangement, furthermore, no transverse forces result from gravitational forces. The mating roll 5 can be arranged above the long-nip press roll 15 as shown, or else below the press roll.

On each of the two bearing pins 7 there is provided an eccentric bearing element 8 on which a support disk 9 for the press shell 4 is turnably mounted. The press shell 4 is fastened by a centering device coaxially on the two support disks 9 in accordance with U.S. Pat. No. 4,625,376. The arrangement is such that the common axis of rotation *9a* of the press shell 4 and the two support disks 9 is arranged offset out of the press plane E, in a direction opposite the direction of travel (arrow 10) of the press shell 4, by a distance a. That is, the axis *9a* is offset from the press plane E in a direction opposite the direction of travel of the press shell 4 over the slide surface 3' of the press shoe 3. Mounting-aid strips 11, on which the press shell 4 slides when it is pushed, upon assembly, in paraxial direction onto the support member 1, are shifted in exactly the same manner. The mounting-aid strips 11 which extend parallel to the support-member axis *7a* are fastened on several struts *11a* and *11b*. A suction channel 12 for a cooling and lubricating liquid is also eccentrically arranged. A feed device for the liquid is designated 13.

It is important for the path of travel of the press shell not to deviate, or deviate only slightly, from a circular shape, so that the innner space enclosed by the press shell can be sealed at both ends. It is furthermore important for the press shell ends to be fastened directly on the support disks so that the inside can be acted on by compressed air.

The drawing furthermore shows that the press shoe 3 is constructed in two parts; namely it is divided into a lower part 14 and an upper part 16. The lower part 14 functions as a piston and is constructed, as seen in cross-section, substantially symmetrical to the press plane E and arranged within the pressure chamber 2. The upper part 16 has the slide surface 3' thereon and is, in contrast, arranged asymmetric to the press plane E. For this purpose, as seen in cross-section, the slide surface 3' is provided on the inlet side, that is, the upstream side with respect to the travel direction 10 of the press shell 4, with an extension 17. The center of the slide surface 3' is thus arranged shifted opposite the direction of travel 10 of the press shell 4 by the amount x from the press plane E. The two distances a and x are so adapted to each other that the aforesaid extension 17 is located substantially within the substantially circular path of revolution of the press shell 4.

In this connection, a further advantage of the invention becomes clear. In prior art systems, for example U.S. Pat. No. 4,643,802, press shoe extensions have bulged the press shell outwards and therefore stressed it relatively extensively. With the present invention this is no longer the case, since it can be seen that the extension 17 is now substantially tangent to the circular path of revolution of the press shell.

Sealing strip supports 18 and 19 serve to guide the press shoe 3 and seal the pressure chamber 2. The press shoe upper part 16 is rounded, again as seen in cross-section, both on the inlet (upstream) side (on the extension 17) and on the outlet (downstream) side.

The paper web 20 which is to be dewatered and which travels through the press nip is shown by a dot-dash line. On each of the sides of the paper web 20, a pair of endless felt belts travel along with the paper web 20, namely an upper felt 21 and a lower felt 22 (both represented by dash lines). For purposes of simplification, it is assumed that the paper web 20, after leaving the press nip, travels in a substantially horizontal direction.

Now a further advantage of the invention is seen. Due to the eccentric arrangement of the press shell 4 and of the corresponding support disks 9, the press shell 4, immediately upon leaving the press nip, moves relatively steeply downward. In other words, in the disclosed embodiment of the invention, the angle c between the horizontal (in the example, represented by the paper web 20), and the tangent 23 to the press shell 4, which is drawn at the outlet from the press nip, is relatively large. In this way the paper web 20, the lower felt 22 and the press felt 4 substantially separate from each other at a very short distance from the outlet out of the press nip. The same is true of the paper web 20 and the upper felt 21. In this way, the result is obtained that the water pressed out of the web of paper in the press nip into the felts either does not flow back at all, or flows back only insubstantially, into the paper web 20 after emerging from the press nip.

In order to optimize this result, it may be necessary to adjust the angle d between the paper web 20 and the felt belt 21, and the angle e between the paper web and the felt belt 22, to given values, for instance approximately 3° each.

As is known, the endless felt belts 21 and 22 run over guide rolls (not visible in the drawing). Their position is so fixed and adjusted that the angles d and e assume optimal values. The two angles d and e need not be the same size. If necessary, at least one of the felt guide rolls can rest in displaceable bearings so that a change in angle is possible during operation.

A suitable guide roll arrangement is disclosed in U.S. patent application Ser. No. 164,540, filed simultaneously herewith (based on DE-P-37 08 191.8 filed Mar. 13, 1987), commonly assigned herewith, whose disclosures are incorporated by reference herein.

Thus it may be advisable, for instance, to vary at least one of the two angles d or e upon a change in the operating speed. For example, one can operate with an angle d or angle e, or both, that is different during the starting of the paper machine than during continuous operation.

Since the angle e between the paper web 20 and the lower felt 22 is relatively small, the further advantage is obtained that the angle between the lower felt 22 and the above-mentioned tangent 23 is relatively large. In this way, it is assured that directly upon the emergence of the lower felt 22 from the press nip, air has access to the bottom of the lower felt 22 ("rear airing"). This circumstance assists in the desired early release of the paper web 20 from the lower felt 22.

The same is true of the upper felt 21. The upper felt 21 forms an angle f with a tangent 24 drawn from the mating roller 5 at the outlet from the press nip. The angle f is selected as large as possible, once again for "rear airing" of the upper felt 21.

Although an embodiment of the invention has been described in detail herein, it is to be understood that the same is by way of illustration rather than limitation, and that modifications and variations thereof may occur to one of ordinary skill in the art, still within the scope of the invention, as defined in the claims.

What is claimed is:

1. A long-nip roll press comprising:

pedestal means;

a support member having a central axis and supported on said pedestal means; and a mating roll having a central axis; said central axes defining a press plane;

a flexible inflatable tubular press shell; means for feeding air into said press shell;

a pair of support disks, each having a central axis, mounted on said support member for rotatably supporting said press shell in a path of travel about a central axis of said press shell; said support member being within said press shell;

said support disks each being rotatably mounted on said support member and coaxial with said central axis of said press shell; said press shell being symmetrically secured at its ends to said support disks;

a press shoe mounted on the support member substantially symmetrically to the press plane; means for displacing said press shoe radially outwardly against an inside surface of said press shell, for pressing said press shell against said mating roll; said press shoe, press shell and mating roll thereby forming an areal press nip between the press shell and the mating roll;

guide means for guiding a web to be dewatered and at least one felt dewatering belt in a web travel direction through said areal press nip for dewatering said web;

said central axis of said support disks and said press shell being offset from said press plane in a direction opposite said web travel direction; whereby said travel path of said press shell is eccentric to said press plane.

2. A roll press as in claim 1, wherein said path of travel of said press shell is substantially circular.

3. A roll press as in claim 1, wherein said means for displacing said press shoe comprises a hydraulic pressure chamber and means for actuating the same.

4. A roll press as in claim 1, wherein said guide means for guiding said web and said at least one felt belt through said press nip is further for guiding a second felt belt through said press nip, said two felt belts sandwiching said web to be dewatered.

5. A roll press as in claim 1, further comprising a plurality of paraxial mounting-aid strips mounted on said support member concentrically with said central axis of said press shell, and thereby eccentrically to said press plane.

6. A roll press as in claim 1, wherein said press shoe has a slide surface which contacts said inside surface of said press shell and defines a width of said areal press nip in the direction of web travel, the center of said slide surface being spaced from the press plane in a direction opposite said direction of web travel.

7. A roll press as in claim 6, wherein said slide surface of said press shoe has an extension on a side of said press shoe opposite said web travel direction, the center of the slide surface of the press shoe being thereby offset from the press plane so that the extension is located substantially within the eccentric path of travel of the press shell.

8. A roll press as in claim 7, wherein said press shell travel path is substantially circular.

9. A roll press as in claim 1, wherein said guide means guides said at least one felt belt and said paper web so that they form with each other an angle of substantially 3° adjacent said press nip.

10. A roll press as in claim 4, wherein said guide means guides said second felt belt and said paper web so that the paper web and the second felt belt form with each other an angle of substantially 3° adjacent said press nip.

11. A roll press as in claim 1, wherein said press plane is substantially vertical.

* * * * *